United States Patent [19]

Vogel et al.

[11] 4,116,422

[45] Sep. 26, 1978

[54] WIRE ANNEALING APPARATUS

[75] Inventors: Ralph A. Vogel, Three Rivers, Mich.; Robert K. Kittsmiller, Fort Wayne, Ind.

[73] Assignee: Essex Group, Inc., Fort Wayne, Ind.

[21] Appl. No.: 797,081

[22] Filed: May 16, 1977

[51] Int. Cl.[2] ..... C21D 9/62

[52] U.S. Cl. ..... 266/104; 219/155; 339/5 RL

[58] Field of Search ..... 219/155; 266/104; 339/5 RL

[56] References Cited

U.S. PATENT DOCUMENTS

| | | | |
|---|---|---|---|
| 2,993,114 | 7/1961 | Bunch et al. | 219/155 |
| 3,518,405 | 6/1970 | Herren et al. | 219/155 |
| 3,530,274 | 9/1970 | Henrich | 219/155 |
| 3,697,335 | 10/1972 | Kyriakis et al. | 219/10.41 X |
| 3,989,923 | 11/1976 | Lees et al. | 339/5 RL X |

*Primary Examiner*—Roy Lake
*Assistant Examiner*—Paul A. Bell
*Attorney, Agent, or Firm*—Lawrence E. Freiburger; Robert D. Sommer

[57] ABSTRACT

A wire annealing apparatus of the type in which an annealing current resistively heats the wire to soften it. The annealing current is caused to flow as a result of a potential difference applied to a section of wire through low friction-free running contact pulleys. Each of the contact pulleys is as friction-free as possible because it is rotatably supported by a ball bearing on a shaft which is rotatably driven at or near the rotational speed at which the pulley is rotated by the wire. The annealing current path between the shaft and the contact pulley is completed through a low friction electrical connector assembly. Annealing current is provided from flowing through the supporting ball bearing.

9 Claims, 3 Drawing Figures

WIRE ANNEALING APPARATUS

BACKGROUND OF THE INVENTION

This invention relates to apparatus for annealing bare wire by resistively heating it, and in particular to improved annealing apparatus for wires. More broadly, however, the invention relates to a free running, low friction pulley assembly for making electrical contact to strand material.

In the prior art, it has been known to anneal bare wire by resistively heating it. In general, the apparatus for carrying out this annealing process has included at least two contact pulleys which serve as electrical contacts to the wire passing around them to cause the annealing current to flow in the section of wire between the pulleys. In the prior art, the contact pulleys have been made of steel or other relatively heavy metal which creates a substantial moment of inertia and rolling resistance. In addition, the brush assembly used with prior art annealing devices to make electrical contact to the pulleys, has also contributed a substantial amount of drag to the pulley assembly. For this reason, in the prior art, the pulleys have, of necessity, been driven by external driving means at a peripheral speed which substantially approximates the wire speed as it moves through the annealer. If the peripheral pulley speed and the wire speed are not exactly synchronized, a limited amount of slip between the wire and the pulley occurs. This slip can, in some cases, be tolerated, but it does cause substantial wear on the pulley which necessitates its repair at intervals more frequent than desired. In other cases, such as when plated wire is being annealed, any slip between the wire and the annealer pulleys, actually causes the plating to be stripped off. It is clear, therefore, that slip cannot be tolerated whenever plated wire is being annealed. It is also possible to synchronize the wire speed and peripheral pulley speed by using an electric control circuit to control the speed of the pulley driving motor, as shown in U.S. Pat. No. 3,697,335, or by providing a magnetic clutch between the driving shaft and the pulley wheel, as shown in U.S. Pat. No. 3,530,274.

In order to overcome the problems associated with prior wire annealing apparatus, the device disclosed in U.S. Pat. No. 3,989,923 was developed. This device utilizes free running (non-driven) contact pulleys which are rotatably mounted on a fixed shaft by low friction bearings. In addition, this device utilizes low torque electrical contacts. While this device operates reasonably well for its purpose, it is desirable to provide a contact pulley which exhibits less friction, to make the annealer as ideal as possible.

SUMMARY OF THE INVENTION

It is thus an object of this invention to provide an improved wire annealing apparatus. It is a further object of the present invention to provide a low friction pulley for such apparatus.

These objects as well as others which will become apparent as the description of the invention proceeds are essentially accomplished by rotatably mounting each contact pulley of the wire annealing apparatus on a shaft which is driven at approximately the same rotational speed as the rotational speed of the pulley, as it is rotated by the wire. With such an arrangement, the pulley is rotated by the wire as it is pulled through the annealer, and by interposing a support bearing between the contact pulley and the driven shaft, frictional losses between the pulley wheel and the driving shaft are minimized. Further, the pulley wheel of the invention is constructed of lightweight material in order to minimize its moment of inertia.

BRIEF DESCRIPTION OF THE DRAWING FIGURES

During the course of the detailed description of the invention reference will be made to the drawing figures in which.

DETAILED DESCRIPTION OF THE INVENTION

Figure 1:
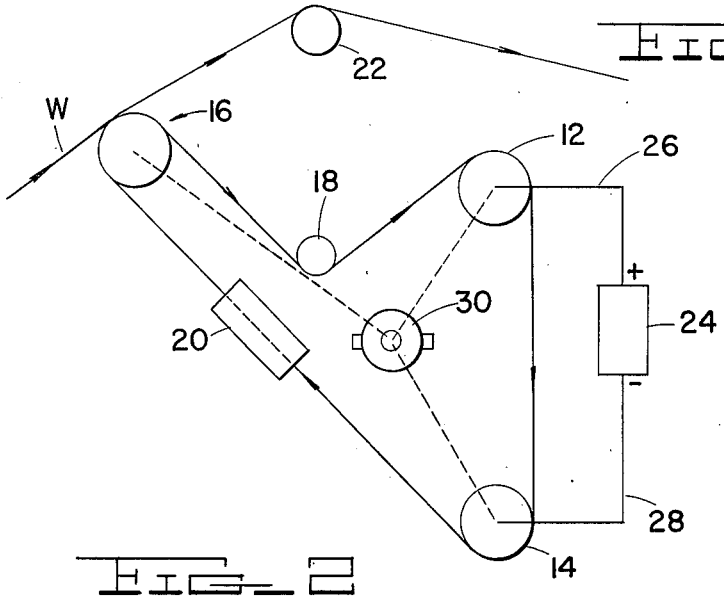
FIG. 1 is a schematic view of a wire annealing apparatus of the invention.

Referring firstly to FIG. 1, the annealing device of the invention preferably includes two single contact pulleys 12 and 14, and a double contact pulley 16. The wire W moves through the annealer in the direction indicated by the arrows. As it is seen in the drawings, the wire W enters the annealer and passes around one wheel of the double contact pulley 16 and thence travels around an idle wheel 18 to contact pulley 12. Idle wheel 18 is placed in the system to ensure that the wire passing around the first wheel of pulley 16 and the wire passing around pulley 12 contacts the pulleys sufficiently enough to make a good electrical contact and help create the correct length and resistance of the wire path. After passing around pulley 12, the wire W passes around the other single contact pulley 14 and into a cooling device 20 which may be a conventional water type cooler. The wire then passes around the second wheel of pulley 16 to a dancer roller 22 and out of the annealer to a take up or other device (not shown) which pulls the wire W through the annealer.

An electrical power supply 24 having a pair of output leads 26 and 28 which are respectively connected to the shafts of pulleys 12 and 14 provides the necessary power to resistively heat the wire W to anneal it. It will be seen that the annealing current travels two paths within the annealer; the first path being through the section of wire directly connecting pulleys 12 and 14; and the second path being through the section of wire between pulley 12 and the one wheel of pulley 16, to the other wheel of pulley 16 and the section of wire connecting it and pulley 14. The three pulleys 12, 14 and 16 are mounted on driven shafts as will hereinafter be described. Preferably the shafts are driven by an electric motor 30 which may be the drive motor for a wire drawing apparatus immediately preceding the annealer. Or, if the annealer is not to be used in combination with a wire drawing device, a separate electric motor 30 may be provided.

Figure 2:
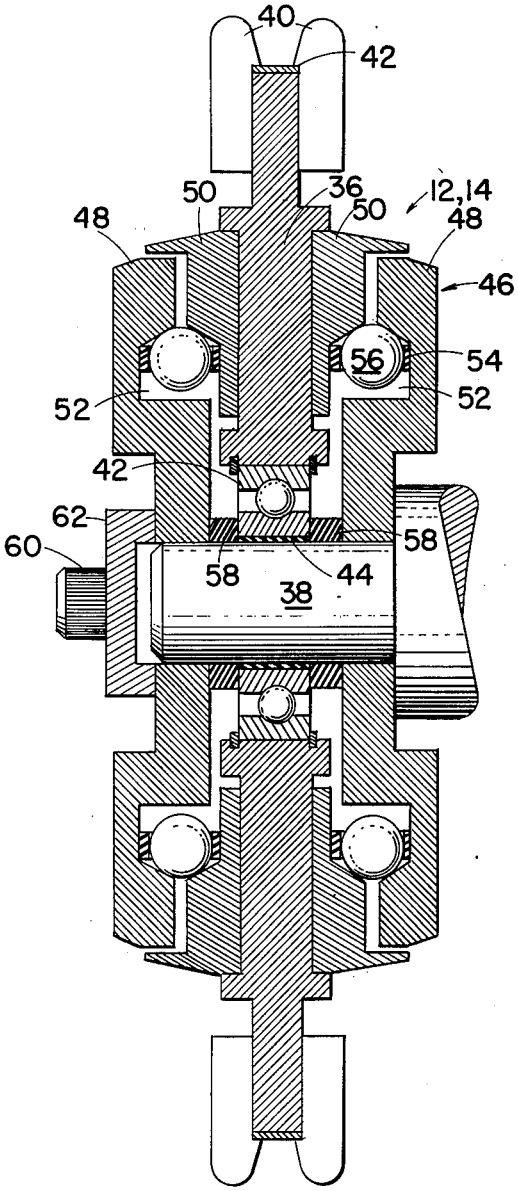
FIG. 2 is a diametrical sectional view of a single contact pulley in accordance with the present invention.
Figure 3:
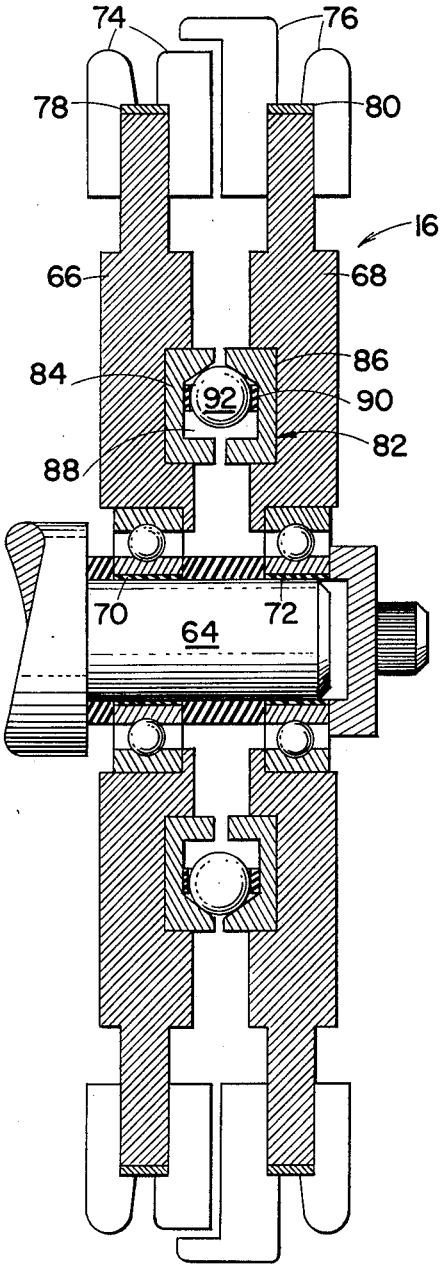
FIG. 3 is a diametrical sectional view of a double contact pulley in accordance with the present invention.

Reference will now be made to FIG. 2 where the structure of the identical contact pulleys 12, 14 is shown. Each of the single contact pulleys 12, 14 includes an annular wheel 36 which is rotatably mounted on a driven shaft 38 which is driven by motor 30. The wheel 36 is constructed of lightweight material such as aluminum in order to keep its moment of inertia as small as possible. At the periphery of the wheel 36, a pair of flanges 40 is situated thereon which serve to guide the wire as it passes around the pulley. Located between the flanges 40 and around the edge of the wheel 36 is a replaceable metal contact band 42 against which the wire abuts as it travels around the pulley.

The wheel 36 is preferably rotatably mounted on shaft 38 by a ball bearing 42 which is interposed between the wheel 36 and shaft 38. A thin layer of electrical insulation 44 is interposed between the bearing 42 and shaft 38 in order to confine the annealing current to an electrical connector assembly as will hereinafter be described. It should now be clear that as the wire is pulled through the system and around the contact pulleys 12, 14, the wheel 36 of each pulley will rotate on bearing 42 around the shaft 38. Since the shaft 38 is being driven at a rotational speed which closely approximates the rotational speed of wheel 36, the pulley assembly is as friction-free as possible.

The output of power supply 24 is electrically connected to shaft 38 by one or more brush assemblies as is well known in the art. Because it is desired that friction between rotating wheel 36 and rotating shaft 38 be kept to a minimum, a low friction electrical connector assembly 46 is provided to complete the electrical connection between shaft 38 and wheel 36. The low friction connector assembly 46 preferably includes a pair of annular contact plates 48 which are situated, and spaced from, each side of contact wheel 36 and are axially mounted on shaft 38 so that they rotate with the shaft 38. When the pulley is assembled, the contact plates 48 cooperate with corresponding annular contact rings 50 secured on wheel 36 to form a ring like recess 52. Situated in recess 52 is an insulative retaining ring 54 of phenolic material having a plurality of radial apertures therein and an electrically conductive contact ball 56 occupying each such aperture. It will thus be seen that retainer 54 permits radial movement of contact balls 54 but prohibits them from moving axially. The balls 56 are made of a reasonably good electrical conductor and hard material such as hard brass, steel or graphite. Further, it will be seen that whenever the pulley assembly is at rest only some of the balls 56 will actually bridge the gap between contact ring 50 and contact plate 48. However, whenever shaft 38 is rotated at the desired speed, the centrifugal force acting on balls 56 will urge them all radially outwardly into contact with ring 50 and plate 48 to complete the electrical connection between them. It will further be appreciated that at operating speeds, there will be little relative movement between ring 50 and plate 48 to effect the desired low friction contact between wheel 36 and shaft 38. The entire pulley assembly is axially placed on shaft 38 along with the necessary axial spacers 58 to maintain the desired spacing between components and is held together by threading bolt 60 through a retainer 62.

The double wheel pulley 16 utilizes the same concept as the single wheel pulleys 12 and 14 to effect the desired low friction mounting. However, since its purpose is to electrically connect the lengths of wire passing around its two wheels, no means is provided for making an electrical connection between the shaft and pulley wheels. It will be clear to those skilled in the art that the double wheel pulley is the preferred way of making this connection, but that two single wheels with electrically interconnected shafts may be employed, if desired.

More specifically, the double wheel pulley 16 includes a driven shaft 64 upon which the two contact wheels 66 and 68 are rotatably mounted on bearings 70 and 72, respectively. As with the single pulley structure, the contact wheels and all components extending radially outwardly on the pulley are constructed from lightweight materials in order to keep the resulting moment of inertia as low as possible. In a similar manner to the single pulley, each wheel of the double wheel pulley has a pair of peripheral flanges 74 and 76, which define a wire engaging slot. In each wire engaging slot, a metallic contact band 78 and 80, preferably of hard brass encircles the rim of each contact wheel. A low friction electrical contact assembly, generally indicated by reference numeral 82, completes the electrical connection between wheels 66 and 68. More specifically, electrical contact assembly 82 includes a pair of contact rings 84 and 86 which are respectively secured to the opposing faces of contact wheels 66 and 68 to form an annular split ring chamber 88 between the contact wheels. A ring shaped phenolic ball retainer 90 having a plurality of radial apertures therein is situated in the split ring chamber 88. The ball retainer serves to maintain the spacing between a plurality of contact balls 92 each of which occupies one of the apertures.

The contact ball retainer in both the double and single pulleys is preferably made from a phenolic material and is loosely fitted into its contact cavity to minimize friction.

It will be appreciated that the speed of the wire as it is pulled through the annealer will vary slightly in speed mainly because inaccuracies in controlling the speed of the spooler. However, because the single pulleys 12 and 14 and double pulley 16 are free running and because the low friction pulleys exhibit a small moment of inertia, the annealer will easily be brought up to speed when the device is started. Further, at operating speeds because of the low friction, small moment of inertia and because the pulleys are free running, no slip between the wire and the pulley wheel takes place as it does with driven pulleys.

Certain obvious modifications will occur to those skilled in the art. Accordingly, it is intended that the foregoing description be made for exemplary purposes only and that the scope of the invention be defined in the claims.

What is claimed is:

1. In an apparatus having an electrical contact pulley which serves as an electrical contact to an electrically conductive strand material passing around said pulley and pulled through said apparatus, an improved contact pulley which comprises:

an electrically conductive wheel having flanges near its rim for guiding said strand;

a shaft driven at a rotational speed substantially equal to the rotational speed of the strand passing around said wheel;

means for rotatably, substantially freely, mounting said wheel on said driven low friction electrical connection means for electrically connecting said shaft and said wheel.

2. The pulley as claimed in claim 1 wherein said low friction electrical connection means comprises:

an electrical conductive plate secured to said shaft in spaced apart, parallel relation to said wheel; and electrical contact means for electrically connecting said conductive plate and wheel.

3. The pulley as claimed in claim 2, wherein said electrical contact means comprises:

a plurality of electrically conductive balls situated to bridge the gap between said conductive plate and said wheel.

4. A wire annealing apparatus, which comprises:

a housing;

a pair of contact pulleys mounted upon said housing;

each said contact pulley comprising a driven shaft on said housing, a contact wheel rotatably mounted for substantially free movement on said shaft, and means for rotatably driving said shaft at substantially the rotational speed of the wire passing around said contact wheel;

power supply means having an output of sufficient potential difference to cause an annealing current to flow in the portion of the wire between said contact pulleys; and low friction electrical connection means for connecting said power supply output and the contact wheels of said contact pulleys whereby said potential difference exits between said contact wheels.

5. The wire annealing apparatus as claimed in claim 4, wherein said contact wheel is rotatably mounted on said shaft by interposing a bearing therebetween.

6. The annealing apparatus as claimed in claim 5, wherein the annealing current is prevented from flowing through said bearing.

7. The annealing apparatus as claimed in claim 6 wherein said low friction electrical connection means comprises:

a first electrical conductor mounted on said driven shaft for rotatable movement therewith; and an electrical contact between said first electrical conductor and said contact wheel.

8. The annealing apparatus as claimed in claim 7 wherein said first electrical conductor is a conductive plate axially secured on said shaft in spaced parallel relation with said contact wheel.

9. The annealing apparatus as claimed in claim 8 wherein said electrical contact means comprises:

a plurality of electrically conductive contact balls situated between said plate and said contact wheel; and retaining means for maintaining said balls in place.

* * * * *

UNITED STATES PATENT OFFICE
CERTIFICATE OF CORRECTION

Patent No. 4,116,422 Dated September 26, 1978

Inventor(s) Ralph A. Vogel and Robert K. Kittsmiller

It is certified that error appears in the above-identified patent and that said Letters Patent are hereby corrected as shown below:

In the Abstract, line 12, "provided" should be --prevented--.

In column 4, line 58, after "driven" insert --shaft; and--

Signed and Sealed this

Ninth Day of January 1979

[SEAL]

Attest:

RUTH C. MASON
Attesting Officer

DONALD W. BANNER
Commissioner of Patents and Trademarks